US007670268B1

(12) United States Patent
Stearns et al.

(10) Patent No.: US 7,670,268 B1
(45) Date of Patent: Mar. 2, 2010

(54) EXERCISE METHODS AND APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 160 days.

(21) Appl. No.: 11/978,332

(22) Filed: Oct. 29, 2007

Related U.S. Application Data

(60) Provisional application No. 60/918,276, filed on Mar. 14, 2007.

(51) Int. Cl.
*A63B 22/04* (2006.01)
*A63B 22/00* (2006.01)

(52) U.S. Cl. ..... 482/52; 482/51; 482/57

(58) Field of Classification Search ..... 482/51–53, 482/57, 70, 79, 80
See application file for complete search history.

(56) References Cited

U.S. PATENT DOCUMENTS 4,185,622 A * 1/1980 Swenson ..... 601/27
5,279,529 A * 1/1994 Eschenbach ..... 482/57
5,383,829 A * 1/1995 Miller ..... 482/57
5,540,637 A * 7/1996 Rodgers, Jr. ..... 482/52
5,882,281 A * 3/1999 Stearns et al. ..... 482/51
6,080,086 A * 6/2000 Maresh et al. ..... 482/57
6,450,925 B1 * 9/2002 Kuo ..... 482/52
6,454,682 B1 * 9/2002 Kuo ..... 482/52
6,620,079 B2 * 9/2003 Kuo ..... 482/51
7,041,036 B1 * 5/2006 Kuo ..... 482/52
7,060,004 B2 * 6/2006 Kuo ..... 482/52

* cited by examiner

*Primary Examiner*—Steve R Crow

(57) ABSTRACT

An exercise apparatus includes a frame configured to rest on a floor surface; left and right cranks rotatably mounted on the frame; left and right drive links having forward ends rotatably coupled to respective cranks, and rearward ends constrained to move in reciprocal fashion relative to the frame; left and right rocker links rotatably mounted on the frame at a common pivot axis; left and right drawbar links rotatably interconnected between respective rocker links and respective drive links; and left and right foot links having forward ends rotatably coupled to respective rocker links, and rearward, foot supporting ends constrained to move in reciprocal fashion relative to respective drawbar links or respective drive links. The resulting linkage assemblies constrain the foot supporting ends to move through elliptical paths, and the paths may be altered by adjusting various components of the linkage assemblies relative to one another and/or the frame.

20 Claims, 8 Drawing Sheets

EXERCISE METHODS AND APPARATUS WITH ELLIPTICAL FOOT MOTION

CROSS-REFERENCE TO RELATED APPLICATIONS

Disclosed herein is subject matter that is entitled to the filing date of U.S. Provisional Application No. 60/918,276, filed Mar. 14, 2007.

FIELD OF THE INVENTION

The present invention relates to exercise methods and apparatus, and more specifically, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to step or climb in place; bicycle machines allow a person to pedal in place; and still other machines allow a person to ski and/or stride in place.

Yet another type of exercise equipment has been designed to facilitate relatively more complicated exercise motions and/or to better simulate the human striding motion. This equipment typically uses a linkage assembly to convert a relatively simple motion, such as circular, into a relatively more complex motion, such as elliptical. Examples of these elliptical motion exercise machines are disclosed in U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; U.S. Pat. No. 6,080,086 to Maresh et al.; and U.S. Pat. No. 6,454,682 to Kuo, all of which are incorporated herein by reference to help provide context for better understanding of the subject invention.

SUMMARY OF THE INVENTION

Generally speaking, the present invention provides novel linkage assemblies and corresponding exercise apparatus that facilitate coordinated total body exercise. On a preferred embodiment, a frame is configured to rest on a floor surface, and left and right cranks are rotatably mounted on the frame. Left and right drive links have forward ends that are rotatably coupled to respective cranks, and rearward ends that are constrained to move in reciprocal fashion relative to the frame. Left and right rocker links are rotatably mounted on the frame at a common pivot axis, and left and right drawbar links are rotatably interconnected between respective rocker links and respective drive links. The rocker links preferably have upper distal ends that are sized and configured for grasping. Left and right foot links have forward ends that are rotatably coupled to respective rocker links, and rearward, foot supporting ends that are supported by respective drawbar links for both pivotal and translational movement relative thereto. On certain alternative embodiments, the rearward ends of the foot links are alternatively supported by respective drive links for both pivotal and translational movement relative thereto. In both instances, the resulting linkage assemblies constrain the foot supporting ends to move through elliptical paths, and the paths may be altered by adjusting various components of the linkage assemblies relative to one another and/or the frame.

Additional features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
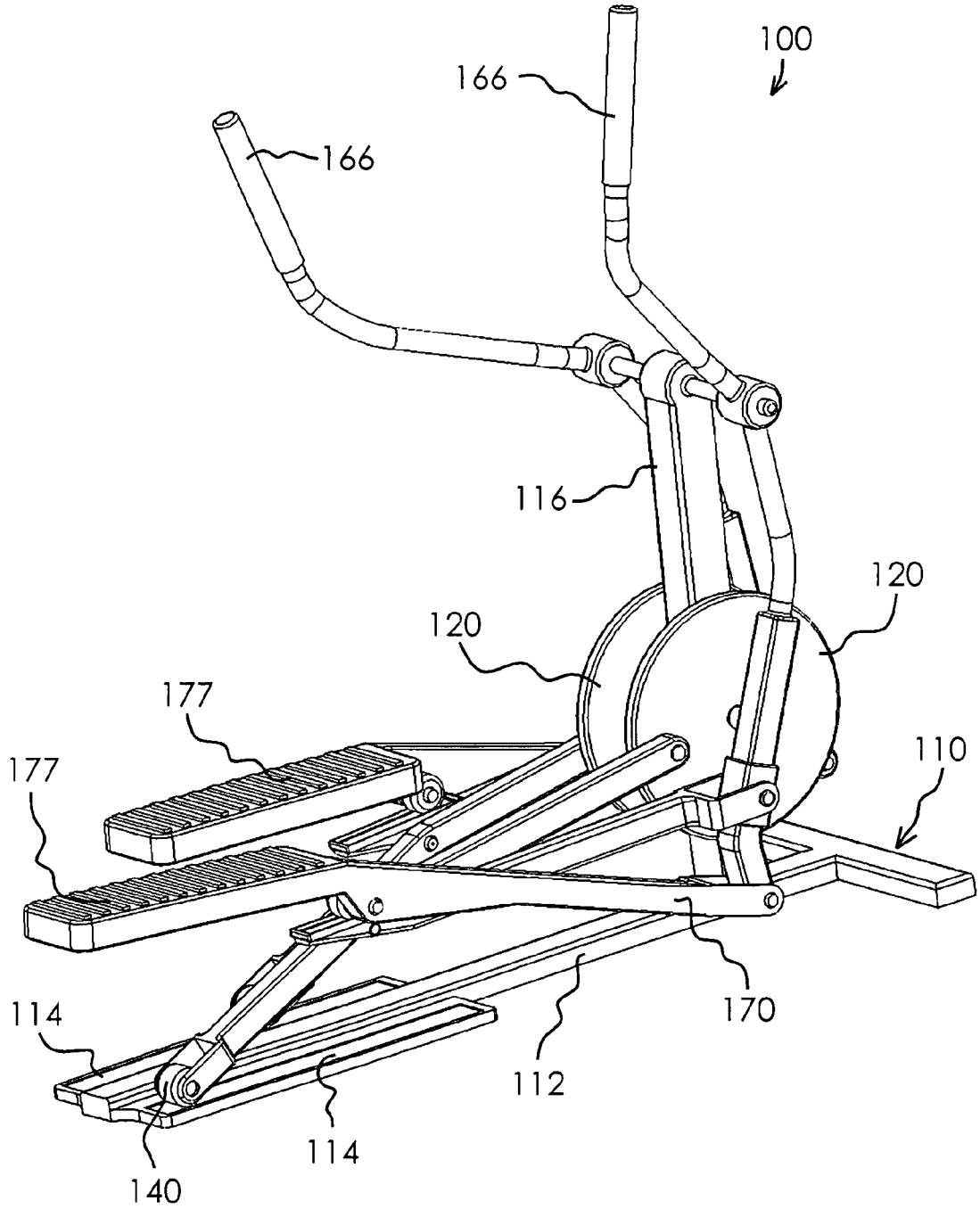
FIG. 1 is a perspective view of an exercise apparatus constructed according to the principles of the present invention.
Figure 2:
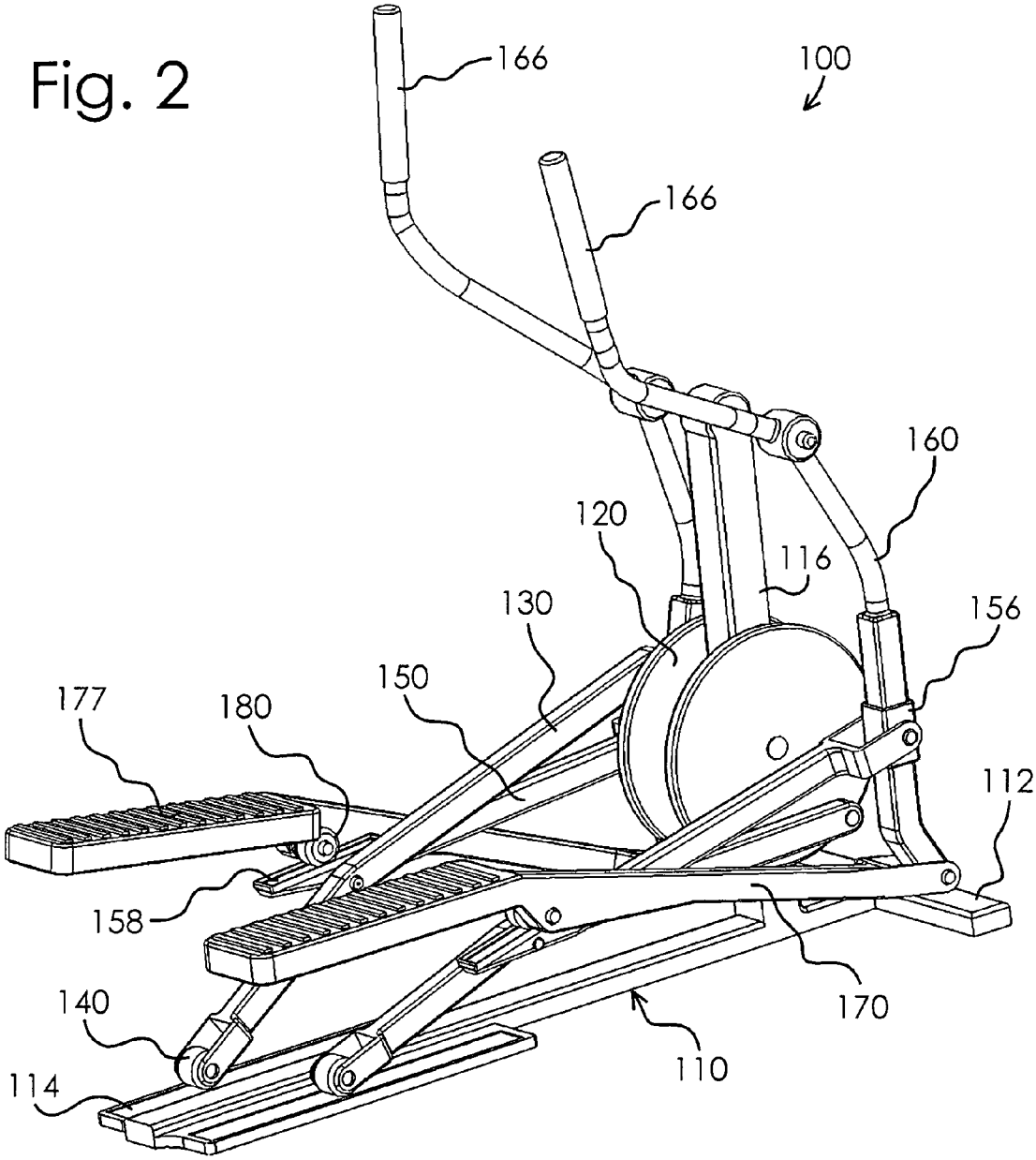
FIG. 2 is the same perspective view of the exercise apparatus of FIG. 1, showing the apparatus set for a relatively longer stride length.
Figure 3:
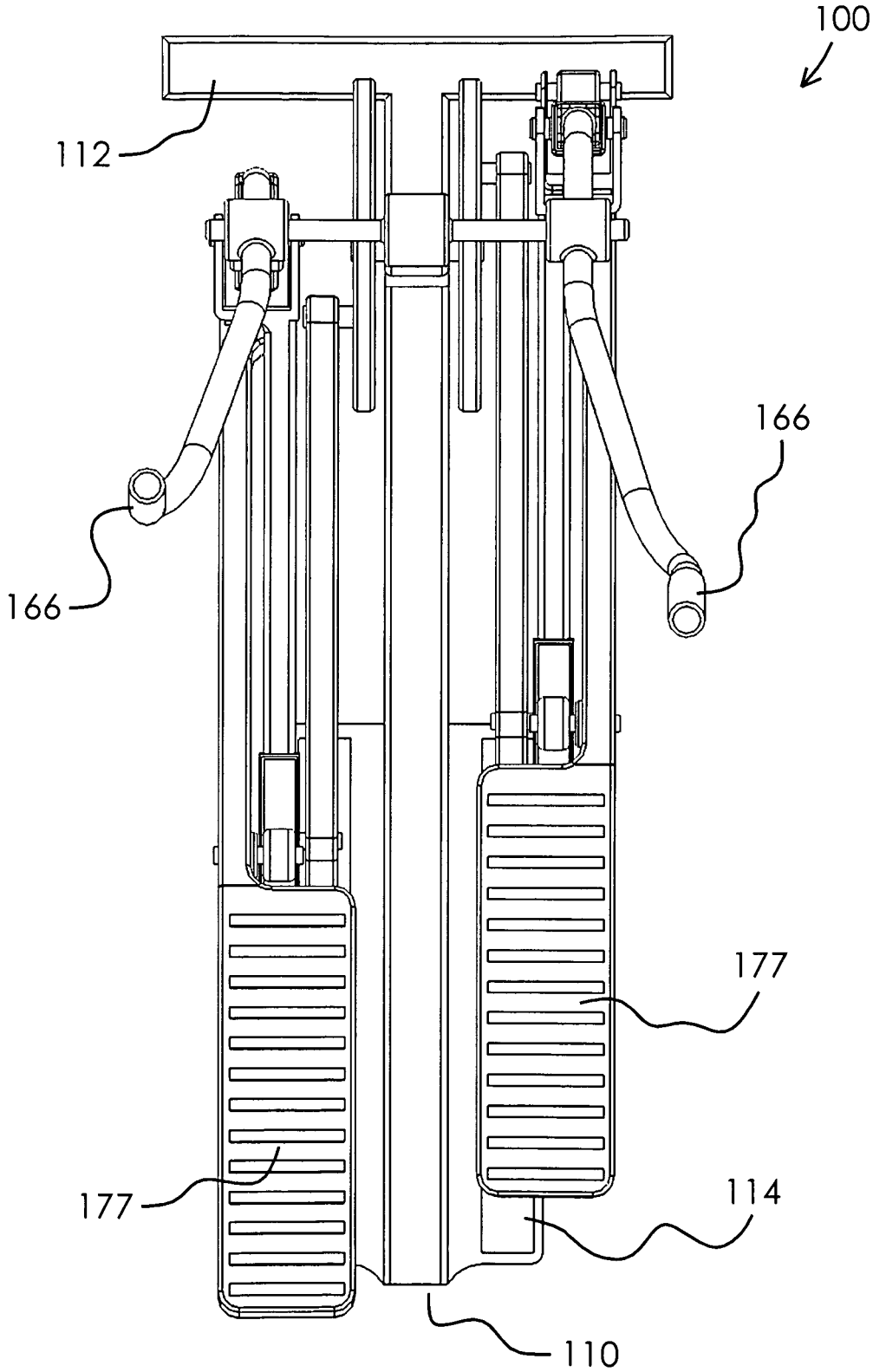
FIG. 3 is a top view of the exercise apparatus of FIG. 1.
Figure 4:
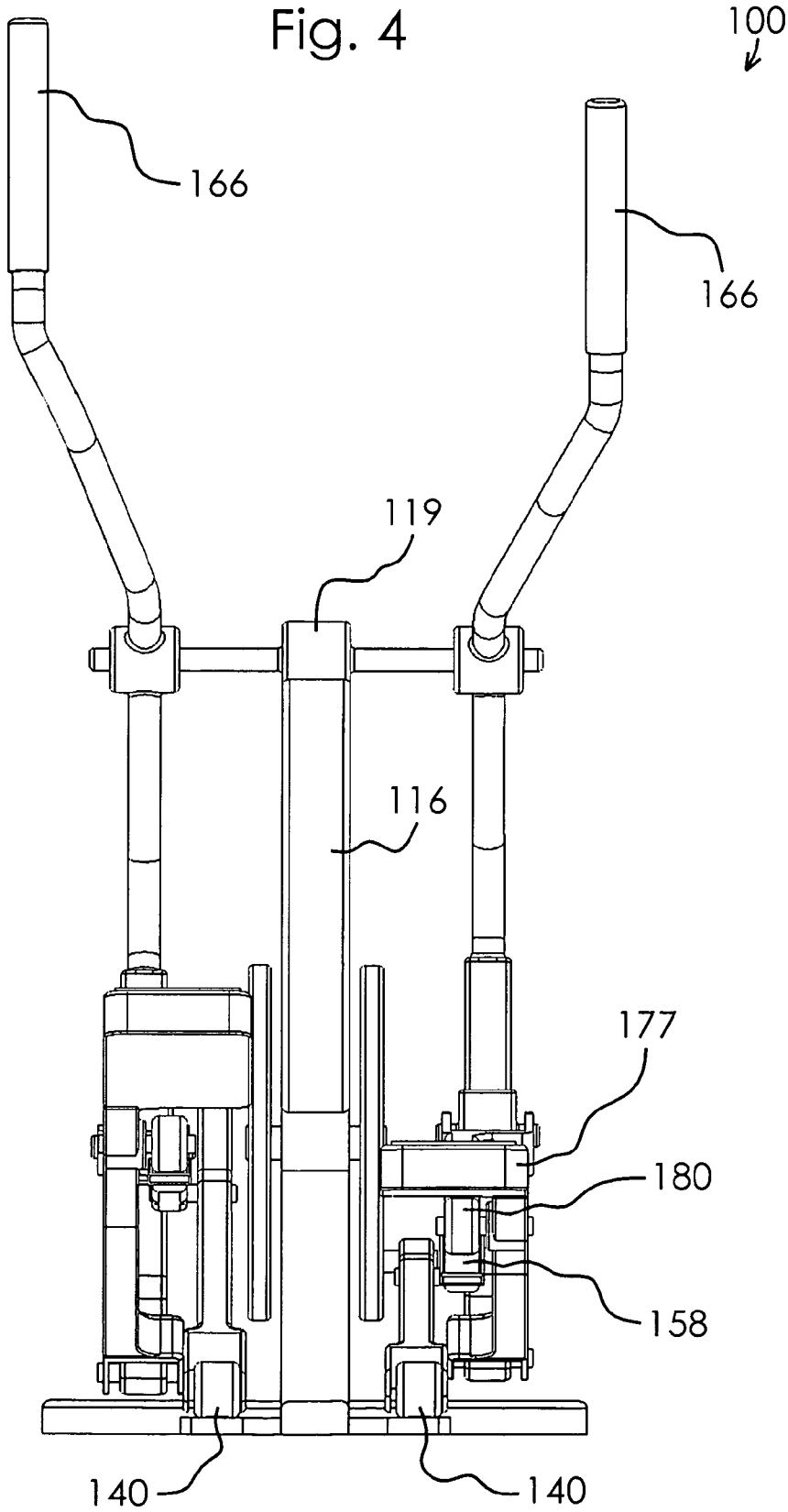
FIG. 4 is a rear view of the exercise apparatus of FIG. 1.

The present invention involves elliptical motion exercise machines, and methods that link generally elliptical motion of left and right foot supports to rotation of left and right cranks and/or arcuate motion of left and right handlebars. The term "elliptical motion" is intended in a broad sense to describe a closed-loop path of motion having a relatively longer, major axis and a relatively shorter, minor axis (which extends perpendicular to the major axis). In general, the present invention may be said to use displacement of the cranks to move the foot supports in a direction coincidental with the minor axis, and amplified displacement of crank driven members to move the foot supports in a direction coincidental with the major axis. As a result, the length of the minor axis is more directly a function of the crank diameter, while the length of the major axis is not so restricted.

A preferred embodiment of the present invention is designated as 100 in FIGS. 1-7. The exercise apparatus 100 may be described in terms of a frame 110, and left and right linkage assemblies movably mounted on the frame 110 (and linked to one another). The apparatus 100 is generally symmetrical about a vertical plane extending lengthwise through the frame 110. The linkage assembly components on the left side of the machine are preferably one hundred and eighty degrees out of phase relative to their opposite side counterparts.

The frame 110 includes a floor engaging base 112, left and right guides or tracks 114 mounted on a rearward end of the base 112, and a forward stanchion 116 that extends upward from an opposite, forward end of the base 112. A conventional user interface (not shown) may be mounted on top of the forward stanchion 116 (in the region designated as 119 in FIG. 4). In a manner known in the art, the interface may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) data transmitted over the internet; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

Figure 5:
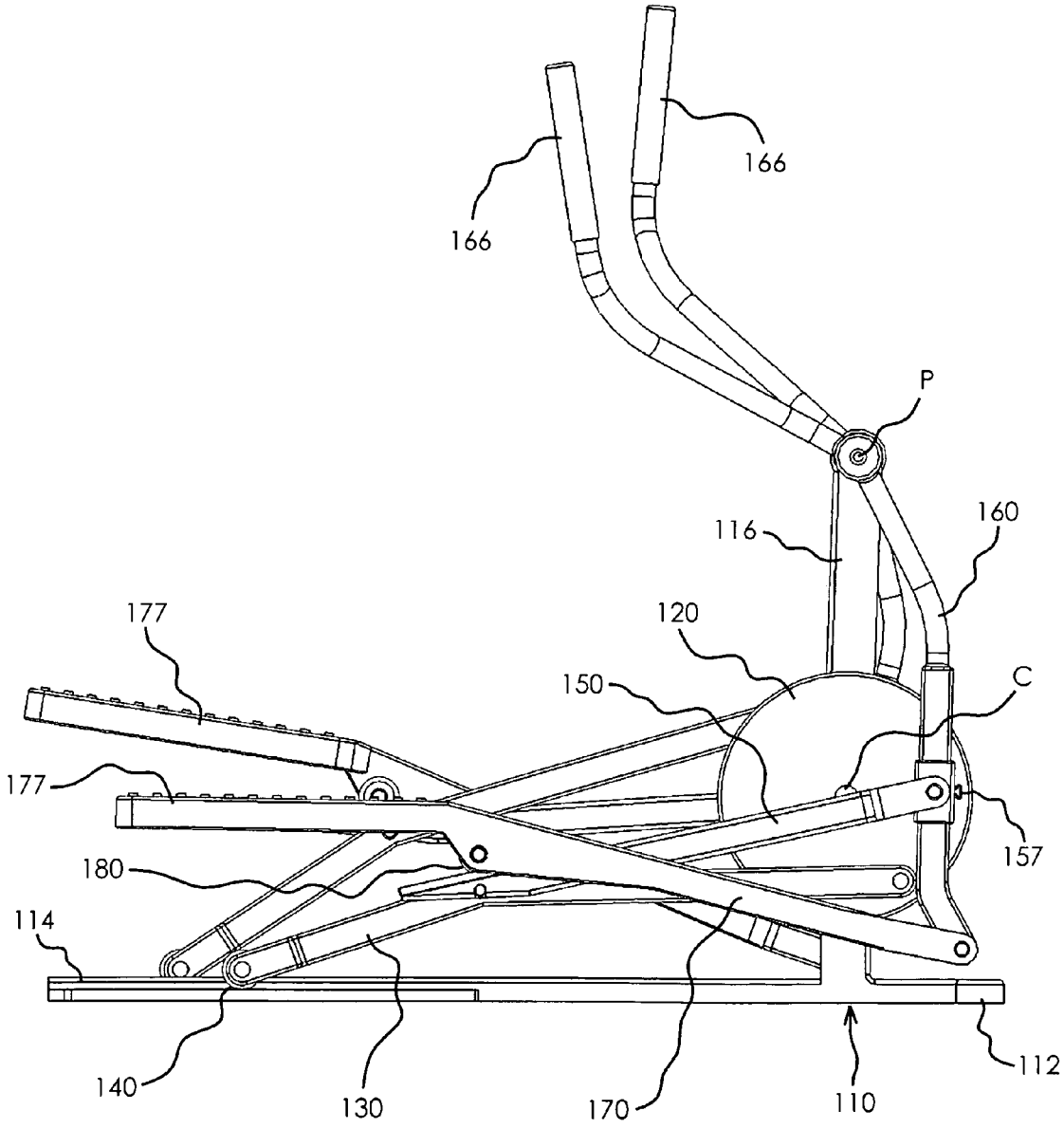
FIG. 5 is a side view of the exercise apparatus of FIG. 1.

A shaft or axle is rotatably mounted on the forward stanchion 116, thereby defining a crank axis designated as C in FIG. 5, and left and right cranks 120 are secured to respective ends of the shaft. The left and right cranks 120 are keyed to the shaft and thereby constrained to rotate together relative to the frame 110. As a matter of design choice, various known inertia altering devices, including flywheels and/or resistance brakes, for example, may be connected to the cranks, either directly or in "stepped-up" fashion using a belt and different diameter drums.

In addition to a respective crank 120, each linkage assembly also includes a drive link 130 having a forward end that is rotatably coupled to a respective crank 120, and a rearward end that is rotatably coupled to a respective roller 140. The rollers 140 are configured and arranged to roll back and forth along respective tracks 114, and each roller 140 may also be described as cooperating with a respective track 114 to constrain an respective rearward end to move in reciprocal fashion relative to the frame 110. An intermediate portion of each drive link 130 is rotatably coupled to a rearward portion of a respective drawbar link 150. An opposite forward end of each drawbar link 150 is rotatably coupled to a lower portion of a respective rocker link 160 (at a respective pivot axis designated as A1 in FIGS. 6-7). As discussed below, each drawbar link 150 underlies and supports a respective foot platform 177, and thus, may also be described as a foot supporting link.

On the preferred embodiment 100, each drawbar link 150 is rotatably coupled to a respective adjustment member or sleeve 156, which in turn, is slidably mounted on a respective rocker link 160. As a matter of design choice, any of several known means may be used to selectively relocate each sleeve 156 along a respective rocker link 160. For example, "ball-detent" push-pins 157 may be inserted through holes in respective sleeves 156 and into any of a plurality of holes disposed along a respective rocker link 160 (at different distances from pivot axis P, which is shown in FIG. 5 and discussed in the next paragraph). As another example, linear actuators may be interconnected between respective drawbar links 150 and respective rocker links 160 (in lieu of the pins 157), and placed in operational communication with the optional user interface described above.

A shaft or axle is rigidly mounted on an upper end of the forward stanchion 116, and an intermediate portion of each rocker link 160 is rotatably mounted on a respective end of the shaft, thereby defining common pivot axis P. Each rocker link 160 has an upper distal end or handle 166 that is sized and configured for grasping, and an opposite, lower end that is rotatably coupled to the forward end of a respective foot link 170 (at a respective pivot axis designated as A2 in FIGS. 6-7). Each foot link 170 has an opposite, rearward end or foot platform 177 that is sized and configured to support a person's foot. Left and right rollers 180 are rotatably coupled to rearward portions of respective left and right foot links 170. Each roller 180 is configured and arranged to roll along a respective guide or track 158 on a rearward portion of a respective drawbar link 150, and may also be described as cooperating with a respective track 158 to constrain a respective foot platform 177 to move in both pivotal and translational fashion relative to a respective drawbar link 150.

Figure 6:
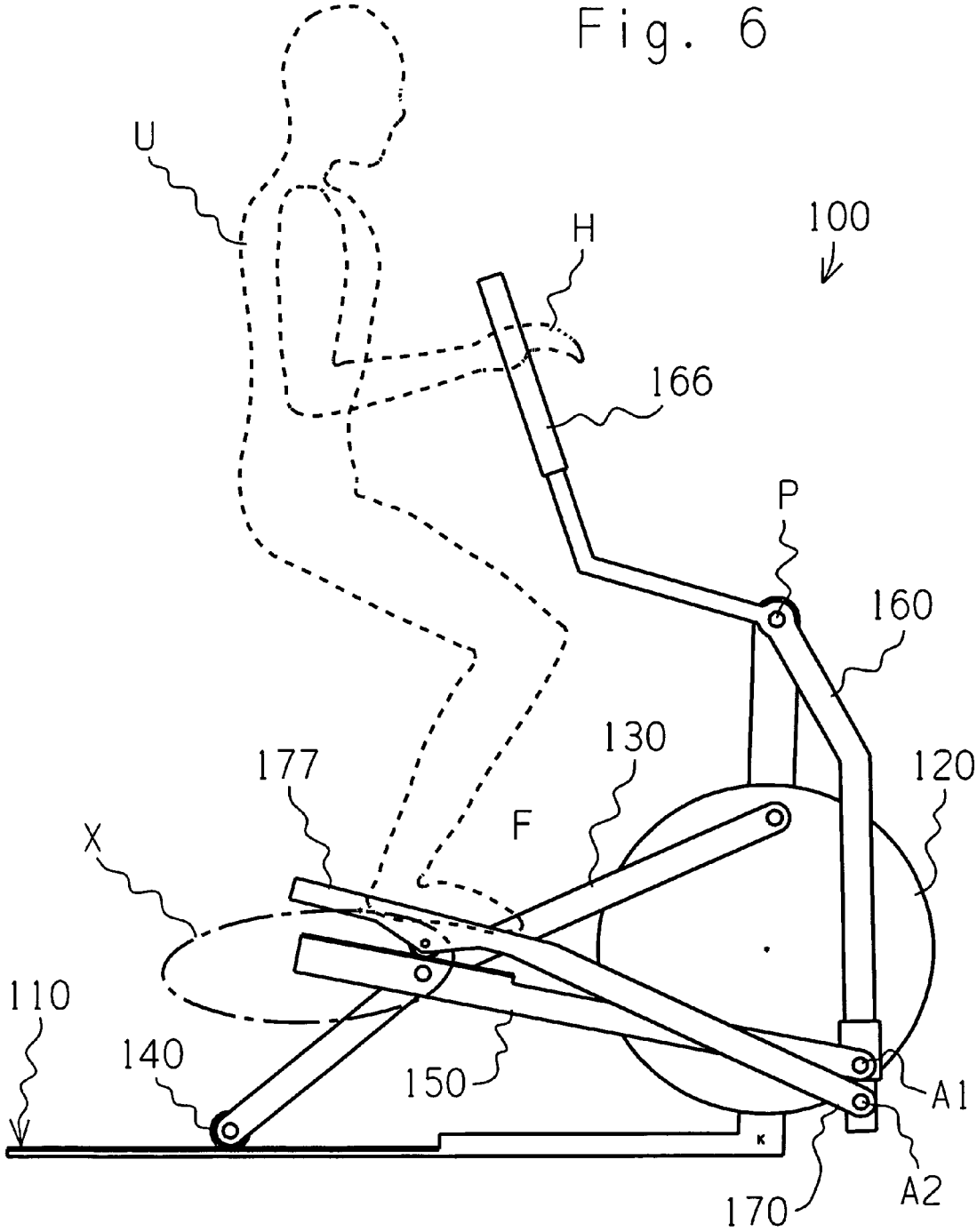
FIG. 6 is a diagrammatic side view of one side of the exercise apparatus of FIG. 1, showing an elliptical path traversed by a person's feet when the apparatus is set for a relatively shorter stride length.

Operation of the apparatus 100 shall be described with reference to FIGS. 6-7, wherein only the right side linkage assembly is shown for clarity of illustration. As shown in FIG. 6, a person or user U places his feet F on respective foot platforms 177, and grasps the handles 166 in his respective hands H. By exerting force through the foot platforms 177 and/or the handles 166, the user U causes the linkage assemblies to move relative to the frame 110, and the cranks 120 link movement of the right linkage assembly to movement of the left linkage assembly.

FIG. 6 shows the pivot axis A1 moved relatively close to the pivot axis A2. In other words, the radial distance between the pivot axis P and the pivot axis A1 is relatively similar to the radial distance between the pivot axis P and the pivot axis A2. When the apparatus 100 is configured in this manner, the pivot axes A1 and A2 travel through comparable arcs about the pivot axis P, and the foot platforms F travel through a relatively short elliptical path (designated as X in FIG. 6).

Figure 7:
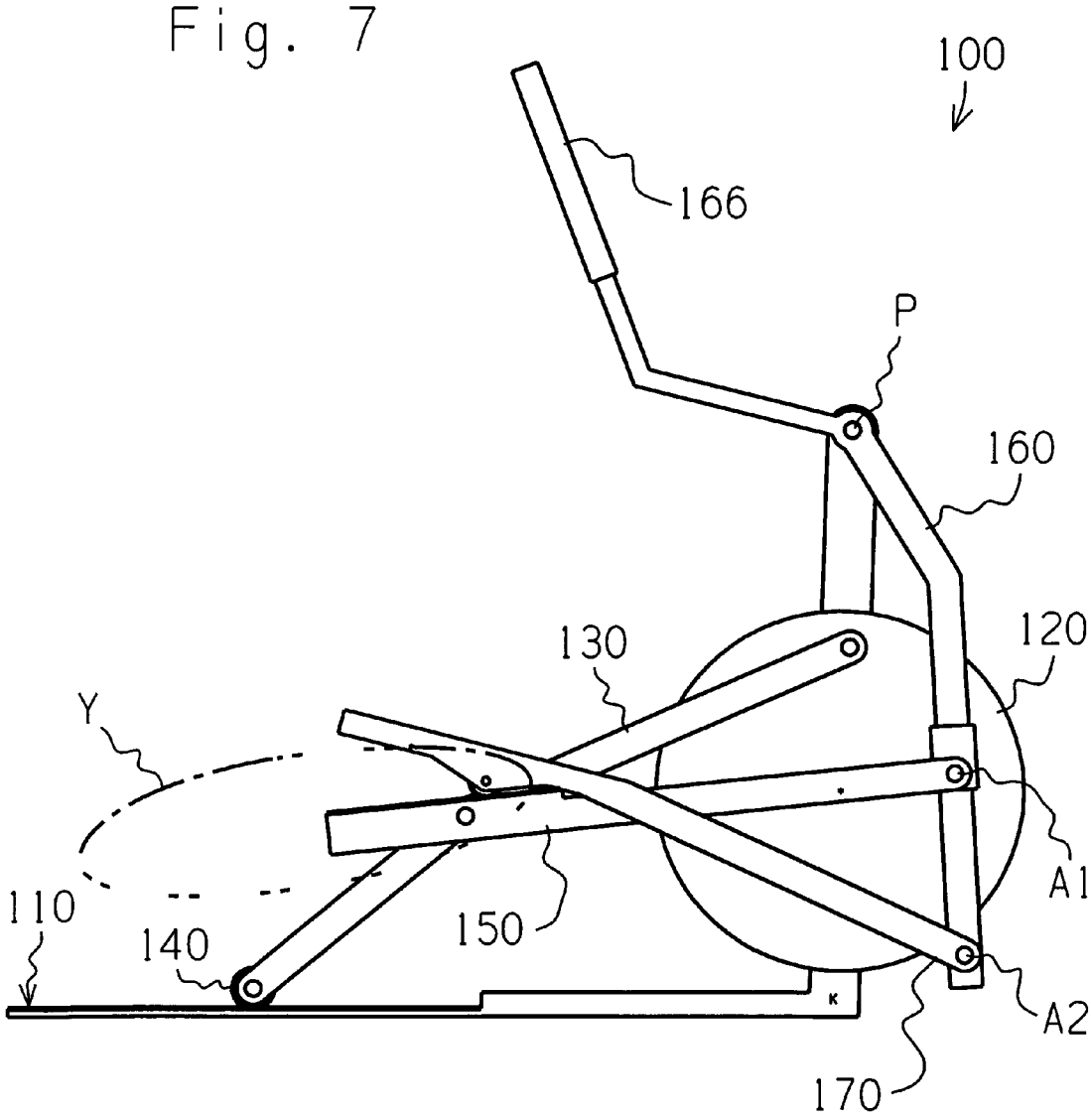
FIG. 7 is a diagrammatic side view of the same one side of the exercise apparatus of FIG. 1, showing an elliptical path traversed by a person's feet when the apparatus is set for a relatively longer stride length.

FIG. 7 shows the pivot axis A1 moved away from the pivot axis A2 (and toward the pivot axis P). In other words, the radial distance between the pivot axis P and the pivot axis A1 is significantly less than the radial distance between the pivot axis P and the pivot axis A2. When the apparatus 100 is configured in this manner, the drawbar links 150 move the pivot axes A2 through a relatively longer, rocker-amplified arc, and the foot platforms F travel through a relatively long elliptical path (designated as Y in FIG. 7). Among other things, it is worth noting that the path Y has a major axis that is longer than a crank diameter defined between the connection points of the drive links 130 and respective cranks 120. Another advantage of the apparatus 100 is that the magnitude of hand movement is linked to the magnitude of foot movement. In other words, an increase in the stroke length of the foot supports 177 simultaneously results in an increase in the stroke length of the handles 166.

Those skilled in the art will also recognize that the linkage assembly components may be adjusted in alternative manners, as well. For example, the drawbar links may be secured in the locations shown in FIG. 7, and the foot links may be adjustable along the rocker links. As another example, both pivot axes A1 and A2 may be fixed in the locations shown in FIG. 7, and the rocker links may be relocated relative to the pivot axis P. Adjustments to other parts of the apparatus 100 may be made in addition and/or in the alternative. For example, the tracks 114 may be modified to be selectively reoriented relative to the base 112 to change the orientation of the foot paths. In any event, it will also be recognized that such adjustments may be made manually, using pins 157 for example, or in response to a control signal, using linear actuators, for example.

Other embodiments of the present invention may be made by moving certain parts and/or connection points. For example, an alternative embodiment may have roller guides or tracks mounted on the drive links, rather than on the drawbar links on the preferred embodiment. Moreover, an additional modification may be made by mounting the rollers on the drive links, and the guides or tracks on the foot links.

Figure 8:
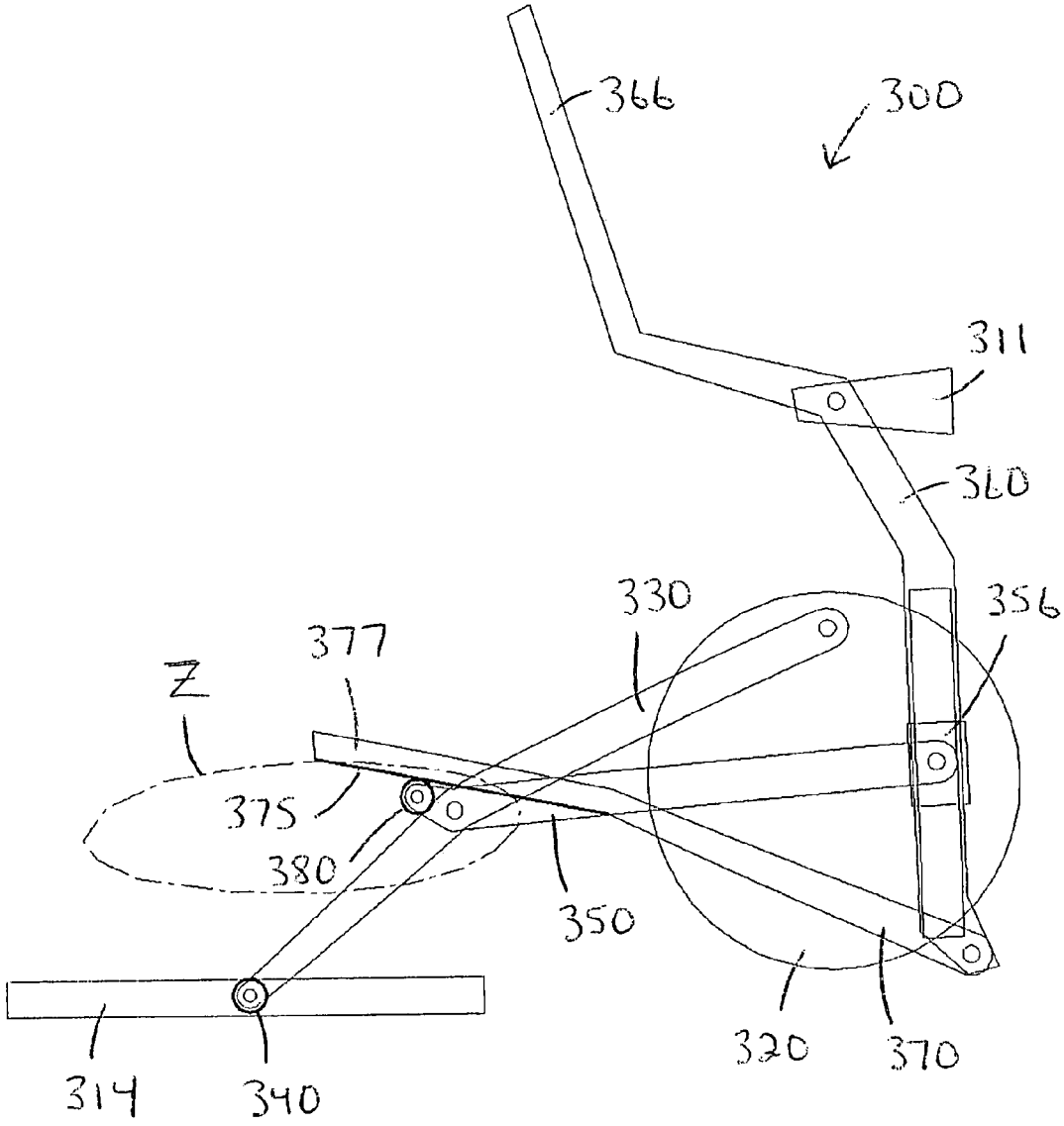
FIG. 8 is a diagrammatic side view of an alternative embodiment exercise apparatus, showing a path traversed by a person's feet when the apparatus is set for an intermediate stride length.

FIG. 8 shows an alternative embodiment exercise apparatus 300 constructed according to the principles of the present invention. In many respects, the apparatus 300 is operationally similar to the preferred embodiment 100. However, the apparatus 300 has foot links 370 supported on rollers 380 that are rotatably mounted on the drawbar links 350, as opposed to having foot link rollers 180 that roll along the drawbar links 150, as on the preferred embodiment 100.

Generally speaking, the apparatus 300 includes a frame that is not shown in its entirety. Among other things, the frame includes an upper stanchion member 311 and rearward guides or tracks 314. Additional frame elements are interconnected between these two components to define a rigid frame that is configured to rest on a floor surface, and support left and right linkage assemblies above the floor surface.

Left and right cranks 320 are rotatably mounted on the frame and rotate together relative thereto. Each linkage assembly also includes a drive link 330 having a forward end that is rotatably coupled to a respective crank 320, and a rearward end that is rotatably coupled to a respective roller 340. The rollers 340 are configured and arranged to roll back and forth along respective tracks 314, and each roller 340 may also be described as cooperating with a respective track 314 to constrain an respective rearward end to move in reciprocal fashion relative to the frame. An intermediate portion of each drive link 330 is rotatably coupled to a rearward portion of a respective drawbar link 350. An opposite forward end of each drawbar link 350 is rotatably coupled to a lower portion of a respective rocker link 360. A respective roller 380 is rotatably mounted on the rearward end of each drawbar link 350 to underlie and support a respective foot platform 377, as further discussed below. In this regard, each drawbar link 350 may also be described as a foot supporting link.

An intermediate portion of each rocker link 360 is rotatably mounted on the frame member 311. Each rocker link 360 has an upper distal end or handle 366 that is sized and configured for grasping. Each rocker link 360 has an opposite, lower end that is rotatably coupled to the forward end of a respective foot link 370. Each foot link 370 has an opposite, rearward end or foot platform 377 that is sized and configured to support a person's respective foot. Left and right guides or tracks 375 face downward from the rearward portions of respective left and right foot links 370. Each guide 375 is configured and arranged to roll along the roller 380 on a respective drawbar link 350. Each roller 380 may be described as cooperating with a respective track 375 to accommodate movement of a respective foot platform 377 in both pivotal and translational fashion relative to a respective drawbar link 350.

When the apparatus 300 is configured as shown in FIG. 8, a point on each foot platform 377 moves through the depicted path Z. Each drawbar link 350 is rotatably coupled to a respective adjustment member or sleeve 356, which in turn, is slidably mounted on a respective rocker link 360. The sleeves 356 are adjusted along respective rocker links 360 to alter the paths traversed by the foot platforms 377. As discussed above with reference to the preferred embodiment 100, any of several known means may be used to selectively relocate each sleeve 356 along a respective rocker link 360, and/or to adjust the linkage assemblies in alternative ways.

The present invention may also be described in terms of the attributes that are shared among various combinations of the foregoing embodiments. For example, they may be described in common terms as an elliptical motion exercise apparatus, comprising: a frame configured to rest on a floor surface; a left crank and a right crank, wherein each said crank is rotatably mounted on the frame for rotation about a common crank axis; a left drive link and a right drive link, wherein each said drive link has a forward end rotatably coupled to a respective said crank at a respective common crank radius from the crank axis, and a rearward end constrained to move in reciprocal fashion relative to the frame; a left rocker link and a right rocker link, wherein each said rocker link is rotatably mounted on the frame at a common pivot axis; a left drawbar link and a right drawbar link, wherein each said drawbar link is rotatably interconnected between a respective said rocker link and a respective said drive link, and the left drawbar link and the left drive link cooperate to define a left linkage, and the right drawbar link and the right drive link cooperate to define a right linkage; and a left foot link and a right foot link, wherein each said foot link has a forward end rotatably coupled to a respective said rocker link, and a rearward, foot supporting end movably supported on a respective said linkage and movable through an elliptical path having a major axis that is more than double the common crank radius.

The present invention may also be described in terms of various methods with reference to the foregoing embodiments. For example, the present invention may be described in terms of a method of amplifying stride length on an elliptical machine having a frame configured to rest on a floor surface; left and right cranks rotatably mounted on the frame for rotation about a common crank axis; left and right drive links having forward ends rotatably coupled to respective said cranks at a common crank radius from the common crank axis, and rearward ends constrained to move in reciprocal fashion relative to the frame; left and right rocker links rotatably mounted on the frame at a common pivot axis; and left and right foot supporting links rotatably interconnected between respective said rocker links and respective said drive links, comprising the steps of: providing left and right foot platform links having respective rearward ends sized and configured to support a person's respective feet; movably connecting the rearward ends of the foot platform links to respective said drawbar links for both pivotal and translational movement relative thereto; and movably connecting opposite, forward ends of the foot platform links to respective said rocker links for rotation relative thereto and for pivoting about the common pivot axis through arcs greater in length than double the common crank radius.

The present invention has been described with reference to specific embodiments and a particular application, with the understanding that persons skilled in the art will derive additional embodiments, improvements, and/or applications that nonetheless fall within the scope of the invention. Therefore, the scope of the present invention should be limited only to the extent of the following claims.

What is claimed is:

1. An elliptical motion exercise apparatus, comprising:

a frame configured to rest on a floor surface;

a left crank and a right crank, wherein each said crank is rotatably mounted on the frame for rotation about a common crank axis;

a left drive link and a right drive link, wherein each said drive link has a forward end rotatably coupled to a respective said crank at a common crank radius from the crank axis, and a rearward end constrained to move in reciprocal fashion relative to the frame;

a left rocker link and a right rocker link, wherein each said rocker link is rotatably mounted on the frame at a common pivot axis;

a left drawbar link and a right drawbar link, wherein each said drawbar link is rotatably interconnected between a respective said rocker link and a respective said drive link, and each said rocker link and a respective said drawbar link cooperate to define a respective first rocker pivot axis disposed at a first radial distance from the common pivot axis, and the left drawbar link and the left drive link cooperate to define a left linkage, and the right drawbar link and the right drive link cooperate to define a right linkage; and a left foot link and a right foot link, wherein each said foot link has a forward end rotatably coupled to a respective said rocker link, and a rearward, foot supporting end movably supported on a respective said linkage, wherein each said rocker link and a respective said foot link cooperate to define a respective second rocker pivot axis disposed at a relatively greater, second distance from the common pivot axis, whereby each said foot supporting end moves through a respective elliptical path having a major axis that is more than double the common crank radius.

2. The apparatus of claim 1, wherein a left roller is rotatably mounted on the rearward end of the left foot link and rollable along a guide on the left drawbar link, and a right roller is rotatably mounted on the rearward end of the right foot link and rollable along a guide on the right drawbar link.

3. The apparatus of claim 2, wherein each said first rocker pivot axis is selectively movable along a respective said rocker link.

4. The apparatus of claim 3, wherein a left drive roller is rotatably mounted on the rearward end of the left drive link, and a right drive roller is rotatably mounted on the rearward end of the right drive link, and each said drive roller is configured and arranged to roll along a respective guide on the frame.

5. The apparatus of claim 1, wherein the rearward end of the left foot link is rollable across a left roller that is rotatably mounted on the left drawbar link, and the rearward end of the right foot link is rollable across a right roller that is rotatably mounted on the right drawbar link.

6. The apparatus of claim 5, wherein each said first rocker pivot axis is selectively movable along a respective said rocker link.

7. The apparatus of claim 6, wherein a left drive roller is rotatably mounted on the rearward end of the left drive link, and a right drive roller is rotatably mounted on the rearward end of the right drive link, and each said drive roller is configured and arranged to roll along a respective guide on the frame.

8. The apparatus of claim 1, wherein each said first rocker pivot axis is selectively movable along a respective said rocker link.

9. The apparatus of claim 8, wherein a left drive roller is rotatably mounted on the rearward end of the left drive link, and a right drive roller is rotatably mounted on the rearward end of the right drive link, and each said drive roller is configured and arranged to roll along a respective guide on the frame.

10. The apparatus of claim 1, wherein a left drive roller is rotatably mounted on the rearward end of the left drive link, and a right drive roller is rotatably mounted on the rearward end of the right drive link, and each said drive roller is configured and arranged to roll along a respective guide on the frame.

11. An elliptical motion exercise apparatus, comprising:

a frame configured to rest on a floor surface;

left and right cranks rotatably mounted on the frame;

left and right drive links having forward ends rotatably coupled to respective said cranks, and rearward ends constrained to move in reciprocal fashion relative to the frame;

left and right rocker links rotatably mounted on the frame at a common pivot axis;

left and right drawbar links rotatably interconnected between respective said rocker links and respective said drive links; and left and right foot links having forward ends rotatably coupled to respective said rocker links, and rearward, foot supporting ends movably supported on respective said drawbar links for reciprocal movement relative thereto.

12. The apparatus of claim 11, wherein the rocker links and the drawbar links cooperate to define respective first rocker pivot axes disposed at a first radial distance from the common pivot axis, and the rocker links and the foot links cooperate to define respective second rocker pivot axes disposed at a relatively greater, second distance from the common pivot axis.

13. The apparatus of claim 12, wherein the first rocker pivot axes are selectively movable along respective said rocker links.

14. The apparatus of claim 13, wherein left and right rollers are rotatably mounted on the rearward ends of respective said foot links, and the rollers are configured and arranged to roll along respective left and right guides on respective said drawbar links.

15. The apparatus of claim 13, wherein the rearward end of the left foot link is rollable across a left roller that is rotatably mounted on the left drawbar link, and the rearward end of the right foot link is rollable across a right roller that is rotatably mounted on the right drawbar link.

16. The apparatus of claim 12, wherein left and right rollers are rotatably mounted on the rearward ends of respective said foot links, and the rollers are configured and arranged to roll along respective left and right guides on respective said drawbar links.

17. The apparatus of claim 12, wherein the rearward end of the left foot link is rollable across a left roller that is rotatably mounted on the left drawbar link, and the rearward end of the right foot link is rollable across a right roller that is rotatably mounted on the right drawbar link.

18. The apparatus of claim 11, wherein left and right rollers are rotatably mounted on the rearward ends of respective said foot links, and the rollers are configured and arranged to roll along respective left and right guides on respective said drawbar links.

19. The apparatus of claim 11, wherein the rearward end of the left foot link is rollable across a left roller that is rotatably mounted on the left drawbar link, and the rearward end of the right foot link is rollable across a right roller that is rotatably mounted on the right drawbar link.

20. A method of amplifying stride length on an elliptical machine having a frame configured to rest on a floor surface; left and right cranks rotatably mounted on the frame for rotation about a common crank axis; left and right drive links having forward ends rotatably coupled to respective said cranks at a common crank radius from the common crank axis, and rearward ends constrained to move in reciprocal fashion relative to the frame; left and right rocker links rotatably mounted on the frame at a common pivot axis; and left and right foot supporting links rotatably interconnected between respective said rocker links and respective said drive links, comprising the steps of:

providing left and right foot platform links having respective rearward ends sized and configured to support a person's respective feet;

movably connecting the rearward ends of the foot platform links to respective said drawbar links for both pivotal and translational movement relative thereto; and movably connecting opposite, forward ends of the foot platform links to respective said rocker links for rotation relative thereto and for pivoting about the common pivot axis through arcs greater in length than double the common crank radius.

* * * * *